United States Patent [19]

Tersteegen

[11] Patent Number: 4,630,523

[45] Date of Patent: Dec. 23, 1986

[54] ELECTROHYDRAULIC REGULATING DRIVE

[75] Inventor: Johannes Tersteegen, Brunswick, Fed. Rep. of Germany

[73] Assignee: Deutsche Forschungs- und Versuchsanstalt fur Luft- und Raumfahrt e.V., Cologne, Fed. Rep. of Germany

[21] Appl. No.: 706,892

[22] Filed: Feb. 27, 1985

Related U.S. Application Data

[63] Continuation of Ser. No. 564,348, Dec. 21, 1983, abandoned, which is a continuation of Ser. No. 259,242, Apr. 30, 1981, abandoned.

[30] Foreign Application Priority Data

May 3, 1980 [DE] Fed. Rep. of Germany ..... 3017080

[51] Int. Cl.[4] ..... F01B 25/26

[52] U.S. Cl. ..... 91/1; 91/433; 91/443; 91/445; 91/447; 91/454; 91/463

[58] Field of Search ..... 91/1, 35, 447, 454, 91/464, 443, 463, 419, 433, 445; 60/329; 137/596.17, 557

[56] References Cited

U.S. PATENT DOCUMENTS

| | | | |
|---|---|---|---|
| 3,338,139 | 8/1967 | Wood | 91/1 |
| 3,838,710 | 10/1974 | Reip | 91/454 |
| 3,874,269 | 4/1975 | Walters | 91/433 |
| 3,951,162 | 4/1976 | Wilke | 91/447 |
| 4,276,811 | 7/1981 | Zeuner et al. | 91/454 |
| 4,281,584 | 8/1981 | Onken et al. | 91/1 |

*Primary Examiner*—Abraham Hershkovitz
*Attorney, Agent, or Firm*—Salter & Michaelson

[57] ABSTRACT

Electrohydraulic regulating device, particularly for aircraft controls, including a regulating cylinder having a regulating piston therein capable of being loaded at either end thereof for the positioning of which necessary volumes of operating fluid can be supplied separately to either end space of the cylinder by means of magnetically-operable valves; a computer by which switch pulses of variable duration to be fed to the magnetically-operable valves are determined in dependence on the specified adjustment distance of the regulating piston; restrictors which determine the throughput of operating fluid through the magnetically-operable valves and sensors which after the switching of a respective magnetically-operable valve generate electrical signals which are fed back to the computer purely as a confirmation of operation. The restrictors are so arranged in an operating fluid circuit that, on movement of the piston, operating fluid flows through only one of the restrictors.

2 Claims, 5 Drawing Figures

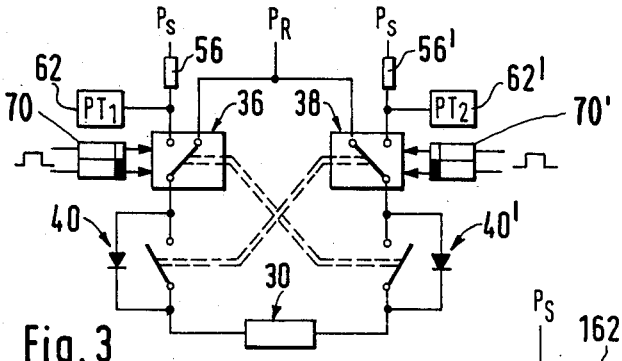
Fig. 3
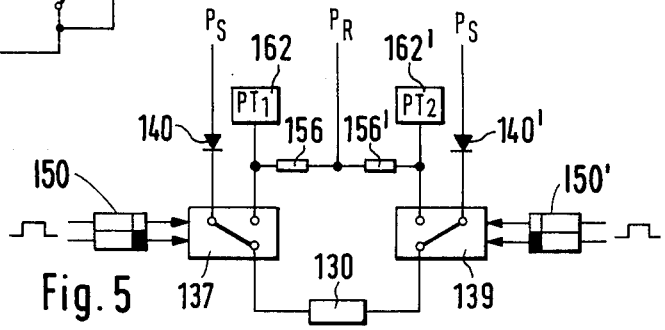
Fig. 5
Fig. 4
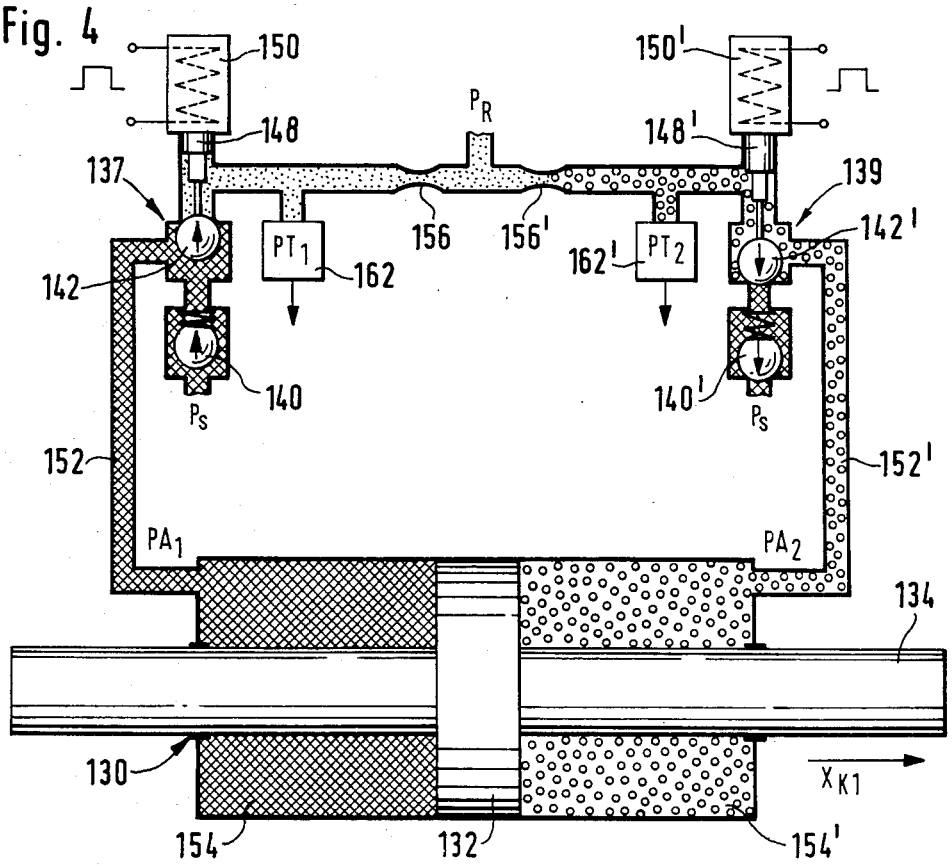

ELECTROHYDRAULIC REGULATING DRIVE

This is a continuation of application Ser. No. 06/564,348 filed on Dec. 21, 1983 (abandoned), which is a continuation of application Ser. No. 06/259,242 filed on Apr. 30, 1981 (now abandoned).

The invention relates to an electrohydraulic regulating drive, particularly for aircraft control devices, including a regulating cylinder having a regulating piston therein capable of being loaded at either end thereof for the positioning of which necessary volumes of operating fluid can be supplied separately to either end space of the cylinder by means of magnetically-operable valves; a computer by which switch pulses of variable duration to be fed to the magnetically-operable valves are determined in dependence on the specified adjustment distance of the regulating piston; restrictors which determine the throughput of operating fluid through the magnetically-operable valves and sensors which after the switching of a respective magnetically-operable valve generate electrical signals which are fed back to the computer purely as a confirmation of operation.

DESCRIPTION OF THE PRIOR ART

An electrohydraulic regulating device of the foregoing type is described in the earlier U.S. application Ser. No. 43,782 Onken et al. In a known embodiment described in that specification, the magnetically-operable valves are, in each case, arranged in a circuit downstream of relief valves opening on the pressure side towards the magnetically-operable valves and restrictors are provided between the magnetically-operable valves and the cylinder end spaces. Connections for sensors acted on by the operating fluid pressure are, in each case, situated between the magnetically-operable valves and the restrictors. In that arrangement the magnetically-operable valves are so arranged that, in the rest position, the cylinder end spaces are, in each case, acted on by the system pressure. Then, for positioning, one of the magnetically-operable valves, in each case, is connected for a predetermined period of time to the return flow. Thus, in each case, the amount of operating fluid flowing out of a cylinder end space is controlled. In that arrangement, pressure changes of up to 50% occur in the regulating cylinder. With small controlled volumes of oil as the operating fluid this leads, as a result of the compressibility of the oil, to non-linearities of more than 10% depending on the setting of the piston, in addition to high frequency alternating loads and thereby to considerable dynamic loading of the seals of the regulating cylinder as well as to a considerable production of noise.

It is an object of this invention to further develop a regulating drive of the type described in the first paragraph of this specification in such a way that linearity between an input signal and the distance of travel of the regulating piston is guaranteed over the whole stroke of the piston and that high frequency alternating loads on the sealing elements in the cylinder chambers are eliminated.

SUMMARY OF THE INVENTION

This object is solved according to the invention in that the restrictors are so arranged in an operating fluid circuit that, on movement of the piston, operating fluid flows through only one of the restrictors.

A first embodiment in accordance with the invention is characterised by the fact that each of the restrictors is arranged on the pressure side upstream of the respective magnetically-operable valve, that stop valves having throughout in the direction towards the cylinder end spaces are provided, in each case, between the respective magnetically-operable valve and the corresponding cylinder end space of the regulating cylinder, that the stop valves and the magnetically-operable valves are so arranged that, in the rest position of the piston, both cylinder end spaces are closed by means of the stop valves and both magnetically-operable valves are open to the return flow and that, for positioning of the regulating piston towards one end of the cylinder, one of the magnetically-operable valves is switched to throughput to a fluid pressure connection and simultaneously the stop valve upstream of the other cylinder cylinder end space is opened.

Another embodiment in accordance with the invention is characterised by the fact that the restrictors are, in each case, arranged downstream of the respective magnetically-operable valve and connected to the return fluid flow line and that a relief valve is arranged, in each case, upstream of the magnetically-operable valve with throughput towards the magnetically-operable valve.

Conveniently each magnetically-operable valve is of the three/two-way type (i.e., a valve having three connections and two switch positions).

BRIEF DESCRIPTION OF THE DRAWINGS

Embodiments of the invention are illustrated by way of example in the accompanying drawings and are described in detail in the following with reference to the drawings, in which:

FIG. 3 illustrates diagrammatically a regulating device of the instant invention which includes the fluid circuit illustrated in FIG. 2;

FIG. 4 shows the hydraulic fluid circuit of a second embodiment of a regulating drive according to the invention, and FIG. 5 diagrammatically illustrates a regulating device which includes the fluid circuit shown in FIG. 4.

DESCRIPTION OF THE PREFERRED EMBODIMENTS

Figure 1:
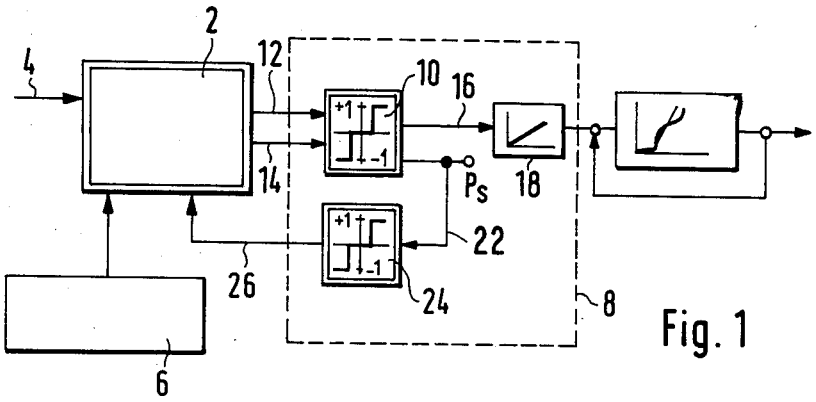
FIG. 1 is a block circuit diagram of an aircraft control and regulation system having an electrohydraulic regulating drive as a servo unit for rudder adjustment.

The control and adjustment system in accordance with FIG. 1 includes a process computer 2 acting as an autopilot, into which pilot commands are fed as rated values. The flight position magnitudes 6, determined in usual way, are fed to the process computer 2.

Block 8, enclosed in broken lines, shows the regulating device according to the invention in a simplex embodiment having failure detection. This regulating device includes electrohydraulic switch valves 10 which are controlled by the process computer 2 through electrical signal leads 12, 14. The switch valves 10 are connected to a hydraulic supply system, not illustrated in FIG. 1. Oil is fed to a regulating drive 18 through a conduit 16. A sensor 24, operating in dependence on pressure and/or flow, is connected to a pressure conduit $P_s$ through a conduit 22 and, at each response, produces an electrical signal which is fed back to the process computer 2 through a signal lead 26 as a confirmation as operation. The electrical signals generated by the sensor 24 are compared in the process computer 2 with the electrical control pulses for the switch valves 10 so that failure, for example failure of the switch valve to switch over, is directly recognisable. A rudder adjustment device 28 is controlled by means of the proportionally-operating regulating drive 18 and activates the rudder, not illustrated in FIG. 1. The rudder adjustment device 28 is designed as a hydraulic power drive, the control means of which are activated by the regulating drive. Thus at least one of the piston rods or regulating pistons of the regulating drive may be designed as the regulating piston of a regulating valve.

Electromagnetic three/two-way valves (i.e. valves having three connections and two switch positions), which are also capable of bistable working are provided as the electrohydraulic pilot valves. Valve switching times of the order of magnitude of 1 ms. can be achieved with special ball valves. The valve switching time should be as small as possible since the resolving power depends directly on it. The throughput of each valve can be adjusted to the value required at any given time by pulse modification, where the valve is controlled by the method of differential modulation of the pulse duration.

In order to eliminate the effect of changes in cross-sectional area within the valve which influence the volume flow the circuit valves are preferably designed to function only as switches. The volume flow is then determined only by a viscosity-independent restrictor.

Figure 2:
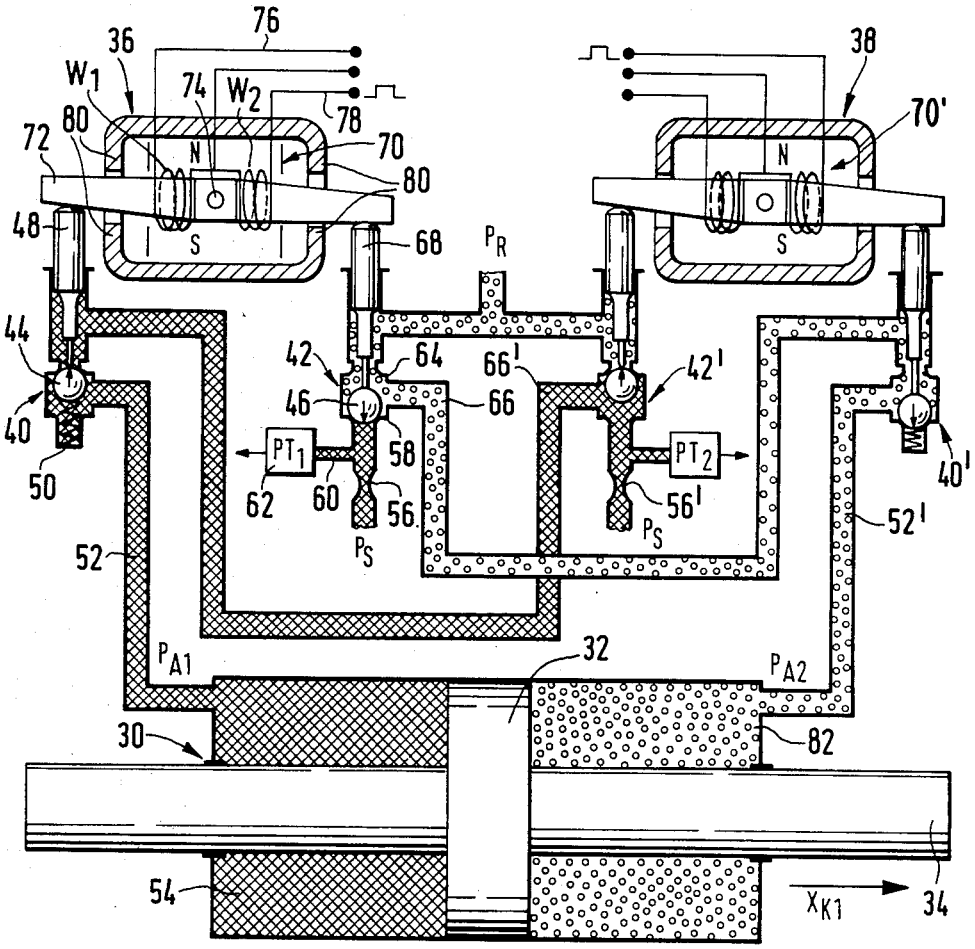
FIG. 2 shows the hydraulic fluid circuit of a first embodiment of the regulating drive according to the invention.

In the embodiment according to FIG. 2, a regulating cylinder 30 is provided with a double-acting regulating piston 32. According to the conditions of use, the load surfaces of the regulating piston may be equal or unequal. The piston rod 34 is designed to be continuous and is led out through the two ends of the cylinder. Two electromagnetically-operated bistable three/two-way valves 36,38 are provided for the activation of the supply or discharge of hydraulic oil for the regulating cylinder 30. These may be designed to be identical and may both be integrated in a single housing. The two circuit valves 36,38 are designed for one-stage operation. The circuit valve 36 includes a stop valve 40 and a reversing valve 42, the valves 40 and 42 having spheres 44, 46 respectively, as valve closure members. The stop valve 40 can be opened mechanically by means of a valve tappet 48 which loads the sphere 44 against the force of a spring 50. The stop-valve 40 is connected with the cylinder space 54 of the regulating cylinder 30 by means of a conduit 52, where the stop valve opens in the direction towards the conduit 52. The circuit valve 38 includes components which are similar to the components of the valve 36 and which are correspondingly indicated by corresponding reference characters having the "prime" designation. The conduits and other components connected to the valve 38 are also similar to corresponding components connected to the valve 36 and are correspondingly indicated by corresponding reference characters having the "prime" designation.

The reversing valve 42 is connected to a hydraulic pressure supply $P_S$ and, in particular, through a restrictor 56. A connection 60 for the pressure sensor 62 is provided between the restrictor 56 and the valve seat 58. The reversing valve 42 is, in addition, connected by means of a second valve seat 64 with the return flow conduit $P_R$. A central connection 66 between the valve seats 58 and 64 is connected to the input of the stop valve 40' of the second circuit valve 38. The spherical valve closure member 46 of the reversing valve 42 is activated mechanically by means of a valve tappet 68 and is pressed thereby against the valve seat 58.

A bistable polarised rotary magnet system 70 having a rotary magnetic armature 72 which pivots about an axis of rotation 74 is provided as the drive of each valve 36, 38. The ends of the arms of the rotary armature 72 act in conjunction with the external ends of the valve tappets 48, 68 and, in particular, preferably by means of adjustable stops not illustrated in the drawing. Windings $W_1$ and $W_2$ which are alternately loaded with current of pulse form by means of the leads 76, 78, are situated on the rotary armature 72. Air gaps between the ends of the arms of the rotary armature 72 and the poles 80 are established by means of adjustable stops.

In order to improve the ease of comprehension, FIG. 3 shows an electrically equivalent circuit diagram of the regulating drive with reference to which the mode of operation of the regulating device will now be explained.

FIG. 3 shows the regulating drive in the rest position. The two circuit valves 36 and 38 are here switched to throughput to the oil return flow $P_R$. The two stop valves 40, 40' are closed and hold the regulating piston 32 of the regulating cylinder 30 in an arrested position between the enclosed oil columns. The restrictors 56, 56' which determine the throughput are, in each case, arranged in the circuit on the supply side in front of the circuit valves 36 and 38. Between each of these flow restrictors and the pressure connection of the respective circuit valve there is situated the connection for the sensor 62 or 62'. When the circuit valve 36 is activated it is switched to throughput while, at the same time, the stop valve 40 is opened, which is shown in FIG. 3, by the bridging of switches situated in parallel. A suitable amount of oil can now flow through the stop valve 40' into the right-hand cylinder space of the regulating cylinder 30 while, at the same time, a corresponding amount of oil can flow away from the left-hand cylinder space of the regulating cylinder 30 through the open stop valve 40. The preloading on the stop valve 40 here counteracts the outflow of oil out of the regulating cylinder 30. The preload may be adjusted in such a way that the counter pressure is about 1% of the system pressure. The outflow of oil therefore acts against no hydraulic pressure other than its flow resistance. Thus the pressure difference across the regulating piston 32 is determined substantially by a force which can be derived from the friction of the regulating piston and the acceleration of the mass of the piston in the direction of motion.

The value of this pressure difference lies below 10% of the system pressure. In this way there is achieved a considerable decrease in the effect of the compressibility of the oil and linearity between the input signal and the respective stroke length is reached over the whole stroke of the piston. Because of the small change in pressure and the low pressure in the chamber, there are advantages in the prolonging of the life of the dynamic seals and in reduction of noise.

An additional advantage of this embodiment lies in the fact that the change in pressure, almost of the magnitude of the system pressure, appearing in the small chambers leading to the respective pressure sensors between the respective valves 42,42' and the restrictors 56,56' results in a large difference between intelligence signals for monitoring the circuit valves 36, 38 even with variations in the system pressure and signal disturbance in the electrical transmission lines.

The mode of operation described with reference to the equivalent circuit diagram of FIG. 3 occurs as follows for a double valve as illustrated in FIG. 2.

The valve 36 is in the rest position in which the conduit 66 is freely connected to the return flow $P_R$ through the valve 42. Supply from the pressure conduit $P_S$ is cut off by the valve 42. The stop valve 40 cuts off the outflow from the left-hand cylinder space 54.

The right-hand circuit valve 38 is switched. Thereby the stop valve 40' is opened and supply of hydraulic oil from the pressure conduit $P_S$ is freed by the valve 42'. Connection to the return flow $P_R$ is cut off by the valve 42'. Oil is able to flow from the pressure conduit $P_S$ through the conduit 66', the stop valve 40 and the conduit 52 into the left-hand cylinder space 54. At the same time oil can flow out into the return flow $P_R$ through the conduit 52', the open stop valve 40', the conduit 66 and the valve 42. Thus the piston 32 moves and with it the piston rod 34. After the opening of the valve 42' an electrical signal is fed back to the process computer 2 by means of the pressure sensor $PT_2$ connected behind the restrictor 56', said signal being produced by the change of pressure in the oil volume between the restrictor and the valve and is a confirmation that the valve 42' has actually opened. The volume of through-flow per unit time is determined by the restrictor 56'. The valve includes no cross-sectional area which determines flow. It therefore operates exclusively as a switch.

After the amount of oil, as predetermined by the process computer 2, has been fed in, the circuit valve 38 is switched back to its original position. Thus the valve 42' shuts off the supply of oil while the stop valve 40' again resumes its closed position. With the closing of the stop valve 40', the oil volume is enclosed between the stop valve 40' and the regulating piston 32 and the regulating piston is constrained to retard its motion. Since it is assumed that no active counter force acts on the piston rod 34, the stop valves 40 and 40' have as their object not to lock the regulating piston in the position which it has assumed (as this will occur in any case by friction of the piston). Instead their object is to stop the moving piston 32 when it reaches its desired position and thus position it exactly without overshooting. For movement of the piston 32 in the opposite direction the valve 36 is switched.

In the embodiment according to FIG. 4 a regulating cylinder 130 with a double-acting regulating piston 132 is again provided and again in this case the impact surfaces may be equal or unequal. The piston rod 134 is designed to be continuous and is led out through the two ends of the cylinder.

Two electromagnetically-operated three/two-way valves 137,139 are provided for activation of the flow of hydraulic oil to and from the regulating cylinder 130 and are designed to be identical and may both be integrated in one housing. The two circuit valves 137, 139 are designed to be one-stage and each includes a stop valve 140,140' as well as a reversing valve 142,142'. The circuit valves and the stop valves have spherical valve closure members. The closure members of the two stop valves 140 open in the direction towards the circuit valves and are connected, respectively, to the pressure conduit $P_S$.

The closure members 142,142' of the two circuit valves 137 and 139 can be activated by the valve tappets 148, 148', respectively, which can be moved by means of electrically actuated drives 150,150'. Said drives 150,150' are preferably plunger-type magnetic drives which are acted on by electrical pulses of variable pulse duration.

The circuit valves 137,139 are connected, on the one hand, through conduits 152,152' with the cylinder spaces 154,154' of the regulating cylinder 130 and, on the other hand, with a return flow conduit $P_R$. These connections are made through restrictors 156,156', respectively. Sensors 162,162' are connected between the restrictors 156,156' and the circuit valves 137, 139 in each case.

In the switch positon according to FIG. 4, the circuit valve 139 is excited and thus the cylinder space 154' is connected to the return flow $P_R$ through the circuit valve 139. On the opposite side, the pressure connection $P_S$ is connected to the cylinder space 154 through the stop valve 140 and the circuit valve 137. Thereby the piston 132 is moved to the right. The fall in pressure occurs through the restrictor 156'. Equal pressure thus exists on both sides of the regulating piston 132, except for the pressure difference due to friction of the piston. Thus effects of alternating loads are eliminated and linearity between the input signal and length of stroke of the regulating piston are insured in the same way as in the embodiment according to FIGS. 2 and 3. After the end of the control pulse supplied to the circuit valve 139, connection of the cylinder space 154' to the return flow is interrupted by the circuit valve 139. The relief valve 140 is closed.

FIG. 5 shows the equivalent circuit diagram for the regulating drive shown in FIG. 4. For activation of the regulating drive 130 the circuit valves 137, 139 are activated respectively. When the circuit valve 139 is activated, as described hereinbefore, the regulating drive 130 is connected with the return flow $P_R$ through the restrictor 156'. Pressure oil can thus flow into the regulating drive 130 from the pressure oil connection $P_S$ through the relief valve 140 and the circuit valve 137, while an equal amount of oil is forced from the said regulating drive through the circuit valve 139 and the restrictor 156' into the return flow $P_R$. Movement of the regulating piston in the opposite direction within the regulating cylinder 130 takes place analagously by the switching of the circuit valve 137.

What I claim as my invention and desire to secure by Letters Patent of the United States is:

1. An electrohydraulic regulating drive, particularly for aircraft controls, comprising a regulating cylinder including a piston with equal load faces capable of being loaded at either side thereof and cylinder chambers connectable alternatingly to the pressure side and the return flow of a hydraulic system, the chambers of said regulating cylinder being adapted to be supplied with oil volumes in the form of discreet oil volumes necessary for positioning the piston by means of electrohydraulic switch valves actuated by a switch pulse sequence, a computer by which the switch pulses to be fed to the valves are determined, and sensors connected between said electrohydraulic switch valves and the pressure side of said system generating electrical signals and being connected to said computer for feeding back said signals thereto, said electrohydraulic switch valves being bistable controlled ball valves, the opening times of said electrohydraulic switch valves being determined by the computer with pulses of variable duration in dependence on the predetermined adjustment distance of the regulating piston, the electrical signals generated by the sensors being fed back to the computer purely as a confirmation of operation, said electrohydraulic regulating drive further comprising stop valves at the pressure side of said hydraulic system opening in direction to the regulating cylinder, and restrictors at the pressure side before the electrohydraulic switch valves for determining the throughput of fluid, the stop valves being each formed as releasable stop valves and being provided between the electrohydraulic switch valves and the corresponding cylinder chambers of the regulating cylinder, the stop valves and the electrohydraulic switch valves being switched in such way that in the resting position both cylinder chambers are closed by the stop valves and both electrohydraulic switch valves are opened towards the return flow, and wherein for positioning the regulating piston always one of the switch valves is switched to open in direction of the pressure side of said hydraulic system and at the same time the stop valve connected to the opposite cylinder chamber is released.

2. An electrohydraulic regulating drive, particularly for aircraft controls, comprising a regulating cylinder including a piston with equal load faces capable of being loaded at either side thereof and cylinder chambers connectable alternatingly to the pressure side or the return flow of a hydraulic system, the cylinder chamber of said regulating cylinder being adapted to be supplied with oil volumes in the form of discreet oil volumes necessary for positioning the piston by means of electrohydraulic switch valves actuated by a switch pulse sequence, a computer by which the switch pulses to be fed to the valves are determined, and sensors generating electrical signals and being connected to the hydraulic system in direction of flow before a respective restrictor for determining the throughput of fluid and being connected to said computer for feeding back signals thereto, the electrohydraulic switch valves being three/two way valves formed as ball valves, the opening time of which can be determined by the computer with variable duration of pulses in dependence on the predetermined adjustment distance of the regulating piston, the electrical signals generated by the sensors being fed back to the computer purely as a confirmation of operation, stop valves positioned at the pressure sides before the respective electrohydraulic switch valves, said stop valves opening in direction towards said electrohydraulic switch valves, the restrictors being always positioned behind the electrohydraulic switch valves in the connection to the return flow, the connections of the sensors to the hydraulic system being provided between the electrohydraulic switch valves and the restrictors and in the resting position both cylinder chambers being connected to the pressure side of the hydraulic system by said electrohydraulic switch valves.

* * * * *